US005235826A

United States Patent [19]

Brooks et al.

[11] Patent Number: 5,235,826

[45] Date of Patent: Aug. 17, 1993

[54] UPHOLSTERY FABRIC

[75] Inventors: Vincent L. Brooks, Royal Oak; Albert L. Traywick, Detroit, both of Mich.; Giles T. Gregory, Nottinghamshire; Gerald F. Day, Derbyshire, both of United Kingdom

[73] Assignee: General Motors Corporation, Detroit, Mich.

[21] Appl. No.: 848,011

[22] Filed: Mar. 9, 1992

[30] Foreign Application Priority Data

Mar. 8, 1991 [GB] United Kingdom ..... 9104895

[51] Int. Cl.[5] ..... D04B 1/22

[52] U.S. Cl. ..... 66/169 R; 66/202; 297/452.58

[58] Field of Search ..... 297/219, 224, 229; 66/169 R, 196, 202

[56] References Cited

U.S. PATENT DOCUMENTS

| | | | |
|---|---|---|---|
| 2,959,837 | 11/1960 | Jette | 66/169 R |
| 3,063,271 | 11/1962 | Faust et al. | 66/169 R |
| 4,320,634 | 3/1982 | Hashimoto et al. | 66/202 |
| 4,604,315 | 8/1986 | McCall et al. | 66/202 X |
| 4,844,539 | 7/1989 | Selbert | 297/219 |
| 5,016,949 | 5/1991 | Yokota | 297/219 X |

FOREIGN PATENT DOCUMENTS

| | | | |
|---|---|---|---|
| 2146870 | 3/1973 | Fed. Rep. of Germany | 297/219 |
| 8629570 | 2/1987 | Fed. Rep. of Germany . | |
| 2448327 | 10/1980 | France | 297/219 |
| 2617206 | 12/1988 | France . | |
| 765895 | 1/1957 | United Kingdom . | |
| 786289 | 11/1957 | United Kingdom . | |
| 2168607 | 6/1986 | United Kingdom . | |
| 2181641 | 4/1987 | United Kingdom . | |
| 2193980 | 2/1988 | United Kingdom . | |
| 2223034 | 3/1990 | United Kingdom | 66/169 R |

OTHER PUBLICATIONS

Knitted Upholstery Fabric Knitting Times Jul. 3, 1972 vol. 41, No. 28 pp. 20-25-Darlington.

Knitted Upholstery Fabrics Knitting Times Oct. 23, 1972 vol. 41, No. 44 pp. 75-77-Blore.

*Primary Examiner*—Clifford D. Crowder
*Assistant Examiner*—John J. Calvert
*Attorney, Agent, or Firm*—Davis Hoxie Faithfull & Hapgood

[57] ABSTRACT

An upholstered three dimensional structure incorporating an internal core and a knitted fabric cover, in which there is provided in the cover a line along which the fabric is less extensible compared to the surrounding fabric, the line being positioned on the fabric such that the line curves over an edge of the core so that on stretching the fabric over the core the less extensible line is displaced from the general plane of the fabric towards the core.

19 Claims, 3 Drawing Sheets

UPHOLSTERY FABRIC

BACKGROUND OF THE INVENTION

1. Technical Field

This invention relates to upholstery fabric intended to cover at least part of the surface of a three-dimensional structure. The invention has particular, but not exclusive, reference to upholstery for an automobile seat, or a seat for other vehicles such as trains, aeroplanes, boats, buses, lorries or other modes of transport. As well as upholstered seats in vehicles or other modes of transport the invention may be used in other upholstered structures in vehicles and modes of transport, such as side cushions for protection or decoration. Further additionally the invention may be used in upholstery for non-transport applications such as seats in houses, offices etc, and upholstered structures generally used for appearance or padding or both.

2. Background Art

The usual method of manufacturing a vehicle seat cover involves converting yarn into woven fabric, cutting out shaped pieces of the woven fabric to make the seat back cover and subsequently sewing these pieces together to form the base and back covers. It is also necessary to provide anchorage devices at the edges of the base and back covers to enable attachment of the covers to respective cushions. Usually these anchorage devices take the form of hollow sewn hems which can be secured to metal rods recessed into the cushions. If the base and/or back cushions comprise bolsters, it is also necessary to provide anchorage devices, usually in the form of open looped flaps, on the undersurface of the cover, in order to conform the cover to the shape of the upper surface of the cushion. Apart from being wasteful in fabric, this method of manufacturing vehicle seat covers is extremely time-consuming and is therefore very costly. Additionally, the amount of time taken to design and produce the warps for weaving; weave the fabric; stenter the fabric; design the patterns; cut and sew, means that design changes in woven seat covers can take eighteen months or more to implement.

Recently, it has been found possible to knit one-piece upholstery fabrics which, without the need for sewing portions together, have the desired shapes to serve as covers for the base and back cushions of a vehicle seat, and incorporate the anchorage devices for the tubes. See UK Patent Application No.2,223,034 A.

An aim of the present invention is to provide such a piece of knitted upholstery fabric with a "mechanical structure" further facilitating its retention on a three-dimensional support, such as a vehicle seat cushion.

SUMMARY OF THE INVENTION

By the present invention there is provided in an upholstered three dimensional structure incorporating an internal core and a knitted fabric cover, the improvement which comprises in the cover a line along which the fabric is less extensible compared to the surrounding fabric, the line being positioned on the fabric such that the line curves over an edge of the core so that on stretching the fabric over the core the less extensible line is displaced from the general plane of the fabric towards the core.

The core may be a foam bun. The line may engage with a recess in the core, or may cut into the core.

The upholstered three-dimensional structure may be a seat, or a part of a seat such as a squab or back.

The line may be formed by knitting the fabric cover such that it is less extensible along the line by virtue of the number, density or type of stitches used. Alternatively at least one reinforcement member may be knitted into the fabric along the line. The reinforcement member may be of a material inherently less extensible than the fabric on knitting. Alternatively, the reinforcement member may be treated after knitting to form the line. The treatment may be heat treatment. The heat treatment may be by steam. The reinforcement member may be a steam shrinkable yarn.

The fabric may be knitted on a flat V-bed machine having independently operable needles. The fabric may be double jersey fabric.

The reinforcement member may be knitted in or inlaid in a course-wise direction. The reinforcement member may be knitted on the rear needles only and may be knitted on only every 2nd, 3rd, 4th, 5th or 6th needle, the reinforcement member being floated over the vacant needles between the beds and therefore between the front and rear of the fabric. There may be a plurality of reinforcement members, each course of reinforcement members picking up the next adjacent needle to the previous course. There may be as many courses as there are sets of knitted-on needles and missed needles, so that, for instance and preferably, if the reinforcement is knitted on one of four needles of a course and floated over three needles, then four courses, or multiples of four courses of reinforcement member would be knitted in. The line is preferably of two to 8 courses, further preferably four or six courses wide when produced in a course wide direction.

The reinforcement material may be an elastomeric thread, but is preferably a heat fusible or heat shrinkable thread. Alternatively combined threads of a heat fusible or shrinkable component together with elastomeric component may be used.

To provide a line in a wale-wise direction, one or two or more needles may be programmed out in the wale-wise direction whilst knitting the fabric, so that there is provided a less extensible line in a wale-wise direction. The line is preferably two to eight wales or further preferably two to four wales wide when knitted in a wale-wise direction.

BRIEF DESCRIPTION OF THE DRAWINGS

By way of example, embodiments of the present invention will now be described with reference to the accompanying drawings, of which.

DESCRIPTION OF PREFERRED EMBODIMENT

Figure 1:
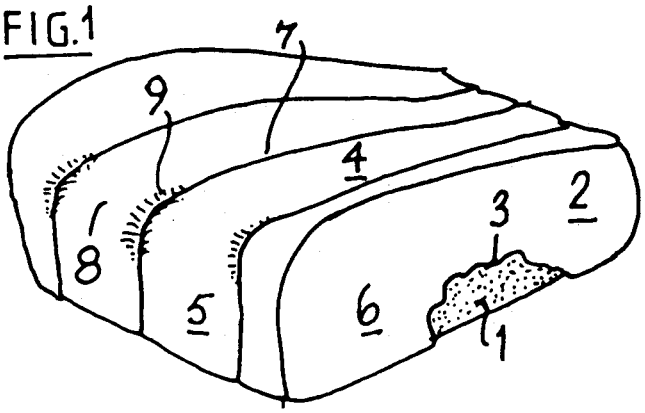
FIG. 1 is a perspective view of a seat squab in accordance with the present invention.

Referring to FIG. 1, this shows in perspective a seat squab being a typical upholstered three dimensional object in accordance with the present invention. The seat squab comprises a foam core 1 and a fabric outer 2. The fabric outer is shown broken away along the line 3 to reveal the core 1. The foam core or bun is often reinforced with a metal frame. The seat may be provided with a back in a known manner. It will further be appreciated that although there is described herein a vehicle seat, other upholstered products in three dimensions may be manufactured in accordance with the present invention.

The cover 2 is knitted in three dimensions on a flat V-bed machine having independently operable needles. The fabric 2 is of double jersey knit. Because the fabric is knitted in one piece it fits tightly over the foam bun 1. Essentially the seat comprises a base portion 4 with a front portion 5 lying in a plane substantially at right angles to the plane of the base portion 4. A pair of side members one of which is shown at 6 lie substantially in parallel planes at right angles to both the base portion 4 and the front portion 5. The seat is completed by a back portion (not shown but lying substantially parallel to the front portion 5) and a base which preferably includes integrally knitted tubes through which rods can be inserted to retain the seat cover on the foam bun.

Figure 7:
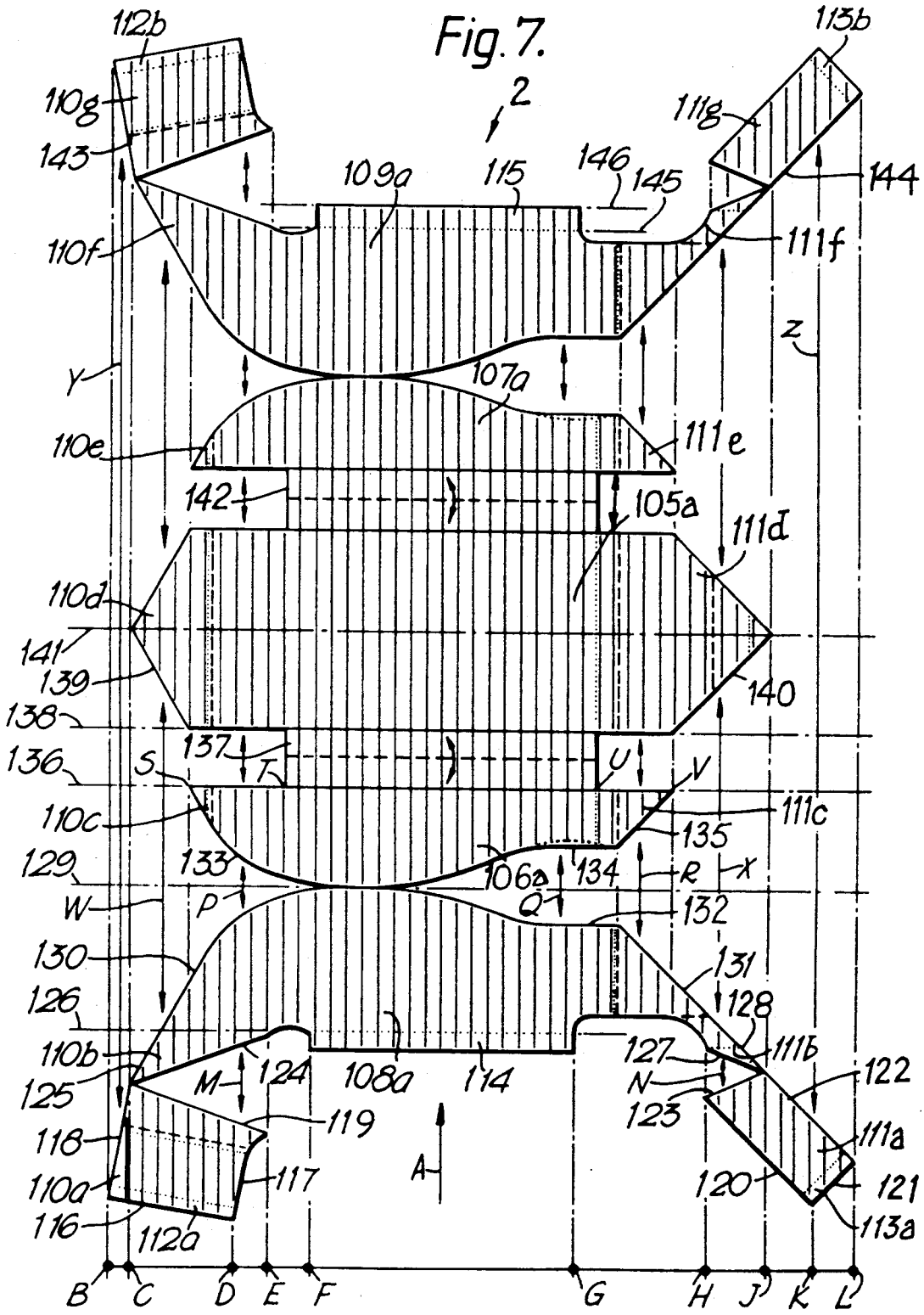
PRIOR ART Fig. 7.

FIG. 7 is a diagram showing one way in which a fabric piece similar to the fabric piece 2 of FIG. 1 can be knitted as a one-piece fabric or mainly double jersey structure on a flat V-bed knitting machine provided with a conventional presser foot device and loop holding-down device for holding down the knitted fabric between the opposed needle beds of the machine. The direction of knitting, indicated by the arrow A, is such that wales of the fabric piece 2 extend, as viewed in FIG. 1 in the direction up the side member 6, across the base portion 4, from side to side of the latter, and down the opposite side member.

Referring to FIG. 7, fabric areas 110*a* and 111*a* form parts of the front portion 5 and rear portion, respectively, in FIG. 1, the fabric area 108*a* forms the side member 6 in FIG. 1 and has end portions 110*b* and 111*b* which form further parts of the front and rear portions, respectively; the fabric area 106*a* forms the bolster-covering portion shown but not numbered in FIG. 1 and has end portions 110*c* and 111*c* which form further parts of the front and rear portions, respectively; the fabric area 105*a* forms the upper surface portion 4 in FIG. 1 and has end portions 110*d* and 111*d* which form further parts of the front and rear portions, respectively; the fabric area 107*a* forms a further bolster-covering portion shown but not numbered in FIG. 1 and has end portions 110*e* and 111*e* which form further parts of the front and rear portions, respectively; the fabric area 109*a* forms the other side member in FIG. 1 and has end portions 110*f* and 111*f* which form further parts of the front and rear portions, respectively; and the fabric areas 110*g* and 111*g* form the final parts of the front and rear portions, respectively.

In FIG. 7, the line BL represents a length of opposed needle beds of the machine on which the fabric piece 2 is knitted. Knitting begins on a few needles in the region of point D of the needle beds to commence formation of the fabric area 110*a*, more and more needles being brought progressively into action in the directions from D to B and from D to E of the needle beds to define the edges 116 and 117. When all the needles from D to B have been brought into action, needles are progressively made inactive in the direction from B to C as further courses are knitted in the direction of arrow A, to define edge 118, each of the needles made inactive along BC retaining its last knitted loop. When all the needles from D to E have been brought into action, needles are progressively made inactive in the direction from E to C as further courses are knitted in the direction of arrow A, to define the edge 119, each of the needles made inactive along EC retaining its last knitted loop. This completes the knitting of the fabric area 110*a*, the portion 112*a* of which, adjacent to the edge 116, is knitted in the form of a tubular hem, in a manner described hereinafter.

At the same time as the knitting of fabric area 110*a* is begun, knitting is also begun on a few needles in the region of point K on the needle beds to commence formation of the fabric area 111*a*. Knitting of this area is performed on needles in the needle bed length HL, in the same way as just described for the fabric area 110*a*, to define the edges 120– 123 of the area 111*a*. The portion 113*a* of the area 111*a*, adjacent to the edge 121, is also knitted in the form of a tubular hem, in a manner described hereinafter.

When the areas 110*a* and 111*a* have been knitted, knitting of the fabric consisting of areas 110*b*, 108*a* and 111*b* is commenced on needles at points C and J of the needle beds. During knitting of the area 110*b* and part of area 108*a*, needles previously made inactive between points C and E are progressively re-activated to join edge 119 to edge 124, as indicated schematically by the arrow M. At the same time, other needles are made progressively inactive in the direction from C towards E to define edge 125, each of these last mentioned needles retaining its last knitted loop. When the course designated 126 has been reached, knitting on needles between points C and E is stopped and knitting is commenced on needles between points F and G to begin the edge portion 114 of fabric area 108*a* up to course 126. The edge portion 114 is knitted as tubular fabric, in a manner described hereinafter. At the same time as the knitting of the area 110*b* and the left-hand portion of the area 108*a* are being performed, the fabric area 111*b* and the right-hand portion of the area 108*a* are knitted, up to the course 126, in the same way as just described for the area 110*a* and the left-hand portion of the area 108*a*. During this stage of the knitting, the edge 123 becomes jointed to edge 127, as indicated schematically by the arrow N and an edge 128 is defined along area 111*b*.

When the fabric has been knitted up to course 126 in all these areas, knitting of the central portion of the area 108*a* is completed up to course 129, the needles being made progressively inactive, and retaining their last knitted loops, to define edges 130, 131 and 132.

Knitting of the area comprising portions 106*a*, 110*c* and 111*c* is then commenced, with the progressive reactivation of needles previously rendered inactive to define the edges 133, 134 and 135. During this stage of the knitting the right-hand part of the edge 130 becomes joined to the edge 133, as indicated schematically by the arrow P, edge 132 becomes joined to the edge 134, as indicated schematically by the arrow Q, and the left-hand part of edge 131 becomes joined to the edge 135, as indicated schematically by the arrow R. When the area comprising portions 106*a*, 110*c* and 111*c* has been knitted up to the course 136, knitting is stopped on needles between points S and T and between points U and V of course 136, each of the needles made inactive retaining its last knitted loop. Knitting is continued on selected needles between points T and U to knit the fabric area 137 up to the course 138. At this course 138, the needles previously made inactive at curse 136 are all brought back into action and the knitting of the fabric area comprising portions 105*a*, 110*d* and 111*d* is commenced. During this stage of the knitting, needles previously made inactive during knitting of the edge 125 of the area 110*b* and the edge 128 of the area 111*b* are brought back into action progressively to define edges 139 and 140. In the performance of this stage of the knitting, the edge 139 becomes jointed to the edge 125 and the left-hand part of the edge 130, as indicated schematically by the arrow W, and the edge 140 becomes joined to the right-hand part of the edge 131 and the edge 128, as indicated schematically by the arrow X. The edges 139 and 140 are completed when knitting reaches the course 141.

Course 141 represents the transverse center-line of the fabric piece 2 and knitting of the remainder of the piece 2 from the course 141 onwards is performed by a procedure which is substantially the reverse of the procedure outlined above for knitting up to the course 141. During this stage of the knitting, a fabric area 142, similar to the area 137, is knitted between the fabric areas 105*a* and 107*a* and a tubular hem 115, similar to the hem 114, is knitted on the area 109*a*.

In the knitting of the final fabric area 110*g* and 111*g*, the needles made inactive along BC and JL during knitting of the areas 110*a* and 111*a* are brought back into action progressively to join the edge 118 of the area 110*a* to the edge 143 of the area 110*g*, as indicated schematically by the arrow Y, and to join the edge 122 of the area 111*a* to the edge 144 of the area 111*g*, as indicated schematically by the arrow Z. During this procedure, the fabric areas 110*a* and 110*g* become joined to form part of the front portion 5 (see FIG. 1) with the portions 112*a* and 112*b* joined end-to-end to form a tubular hem. At the same time, the fabric areas 111*a* and 111*g* become joined to form part of the rear portion (not shown in FIG. 1) with the portions 113*a* and 113*b* joined end-to-end to form a further tubular hem.

All areas of the fabric piece 2, apart from the tubular hems 112*a*, 112*b*, 113*a*, 113*b*, 114 and 115 and the areas 137 and 142 are knitted with a mainly double jersey structure on both beds of the knitting machine.

The hem 115 in FIG. 7 extends between courses 145 and 146. At course 145 the knitting of double jersey structure stops and the knitting of two pieces of single jersey fabric, one on each bed of the machine, continues up to a course situated two courses before the course 146. Double jersey knitting is then resumed on both needle beds for two courses, up to course 146. The result of this is to give the hem 115 a tubular construction. On completion of the course 146, the hem 115 may be cast off the needles and the edge of double jersey fabric sewn to prevent unraveling. Alternatively, one or two courses of fusible yarn may be knitted at the edge of hem 115 after completion of course 146. Subsequent fusion of this fusible yarn prevents unraveling of the two double jersey courses at and adjacent to course 146.

Procedures similar to that just described may be used for knitting the tubular hems 112*b* and 113*b*, but since these hems are inclined to the wale directions of the fabric areas concerned, steps must be taken, as knitting proceeds, progressively to reduce the number of needles employed to knit double jersey structure with a corresponding progressive increase in the number of needles employed to knit the two single jersey fabrics.

The tubular hems 112*a*, 113*a* and 114 may be knitted using procedures which are substantially the reverse of the procedures described above for knitting the tubular hems 112*b*, 113*b* and 115. Thus, for example, the hem 114 is commenced with a double jersey set-up on the two needle beds, which is followed by separate single jersey courses up to course 126. It will, of course, be appreciated that there is no need to take precautions to prevent unraveling of the initial double jersey structure of the hems 112*a*, 113*a* and 114.

In the above described knitting of the fabric piece 2, it will be appreciated that the knitting of the course 138 has the effect of joining the fabric areas 105*a* and 106*a* and forming the fabric area 137 into a loop projecting from the undersurface of the fabric piece 2. Likewise, the fabric area 142 forms another loop projecting from the undersurface of the fabric piece 2.

When the knitting of the fabric piece 2 has been completed, it has the appearance of the seat base cover shown in FIG. 1. To fit the cover to the foam bun 1 (FIG. 1), the loops are slipped over metallic rods (not shown) recessed into the cushion. The metallic rods are slipped into the tubular hems 112–115 and the rods are secured to the underside of the cushion.

Although the seat cover may be integrally knitted as described above with reference to FIG. 7, there is a danger that it may "shuffle" on the base 4 i.e. the seat cover may move over the surface of the base, and pucker or distort any pattern on the cover. The present invention, by providing a "tight line" in the fabric enables the production of an upholstered product which has a pleasing aesthetic appearance and which has the further advantage of resisting shuffling of the fabric on the foam bun.

Formed integrally into the knitted fabric 2 is a tight line 7. The tight line 7 comprises a line in the fabric of less extensibility than the portion of the fabric on either side of or surrounding the line.

When the fabric is stretched over the bun 1 the tight line does not stretch as much as the remaining portion of the fabric and where the fabric is bent over the edge between the planes of the portions 4 and 5—i.e. over the edge indicated generally by 8—the fabric pulls into the bun as is shown at 9 in FIG. 1.

Figure 2:
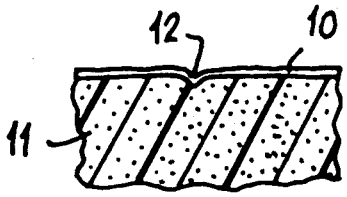
FIG. 2 is a cross sectional view of a fabric and core.

The effect of the fabric cutting into the foam bun can be seen more clearly in FIG. 2.

In FIG. 2 the fabric 10 is stretched over a core or foam bun 11. Where the fabric passes over an edge (such as the edge 8 in FIG. 1) the tight line such as tight line 12 does not stretch as much as the remainder of the fabric and this causes the fabric in the tight line to be stretched out of the general plane of the fabric towards the centre of the bun 1. The tight line is shown at 12 in FIG. 2.

Figure 3:
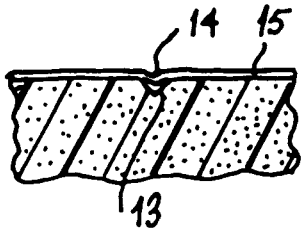
FIG. 3 is a cross sectional view of an alternative form of fabric and core.

The tight line will cut naturally into the foam to form a groove for the line. However for further anti-shuffling effect the foam bun may be preformed with a groove such as groove 13 as shown in FIG. 3 so that the tight line 14 in the fabric 15 lies naturally in the groove 13 when the fabric is stretched over the foam core. This register between the tight line and the groove in the foam core of the seat aids assembly of the seat and further assists in an anti-shuffling effect for the fabric on the core.

It will be appreciated that several tight lines may be produced in the fabric to assist in the anti-shuffling effect. The tight lines 7 may be produced by taking a knitted article and producing a seam of lock stitch on a sewing machine. However, although such a seam is easily produced, it does involve an additional machining operation over and above the knitting of the fabric over.

Figure 4:
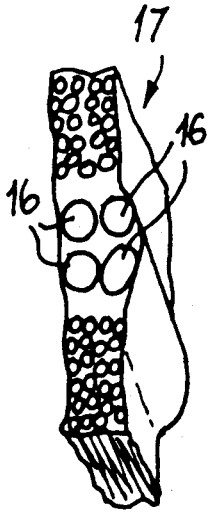
FIG. 4 is a scrap perspective view of a cross section of a fabric in accordance with the present invention.

It is preferred, therefore, that the tight line should be produced integrally with the knitting of the fabric cover which surrounds the tight line on both sides. The tight line may be produced by knitting-in, in a course-wise direction, a less extensible material than the yarn used to produce the fabric. As is shown in FIG. 4 the knitted-in structurally reinforcing yarns 16 may produce the tight line effect in the fabric indicated generally by 17, which fabric is a double jersey knitted fabric.

The knitting-in of the tight lines can be carried out by conventional equipment. Knitting techniques useful to the invention will be found in the following works of reference.

"Knitting" by H Wignell, Published by Pitman 1971 Edition, London

"An Introduction to Weft Knitting" by J. A. Smirfitt, Published by Merrow Technical Library, Watford, England, 1975.

"Advanced Knitting Principles" Edited by C. Reichman, Published by National Knitted Outerwear Association, New York, New York, 1964.

"Fully Fashioned Garment Manufacture" by R. W. Mills, Published by Cassell, London, 1965. and "Knitting Technology" by D. J. Spencer, Published by Pergamon Press, London, 1983.

The knitting may be carried out on a flat bed machine such as:

a Stoll CMS Selectanit machine, for details see Knitting International, May 1990, pages 26–28, or a Steiger Electra 120FF machine, for details see Knitting International, April 1990, page 96, or a Shima Seiki SES machine, for details see Knitting International, September 1989, page 60.

The process may be particularly adapted to produce a tight line by the knitting technique illustrated in FIGS. 5A to 5E.

FIGS. 5A to 5D illustrate eight courses of fabric knitted on two sets of needles, an upper set along the line 20 and a lower set along the line 21. It will be seen that the upper set of needles 20 are numbered from 1 to 4 in two sequences. The reason for this will be noted below.

In knitting the double jersey cover for the seat, the front face of the fabric i.e. the face seen by the purchaser of the seat is knitted on the lower row of needles 21. In this particular instance the face side of the fabric is knitted using a polyester yarn 22. The polyester yarn 22 is knitted on all of the needles 21 in the first course of the tight line structure shown in FIG. 5A. On the reverse side of the fabric, however, a contractile thread formed of a low melting point nylon (or low melting point polypropylene) is knitted only on the first needles labelled needles number 1. This contractile thread 23 is therefore knitted on the number 1 needles in each group of four and floats over needles 2,3 and 4 to be picked up again on needle 1. This sequence continues across the entire width of the fabric being knitted. A typical knitted fabric for a vehicle seat cover would use many hundreds of needles and to produce the tight line the first course of the line would knit on every fourth needle.

Figure 5A:
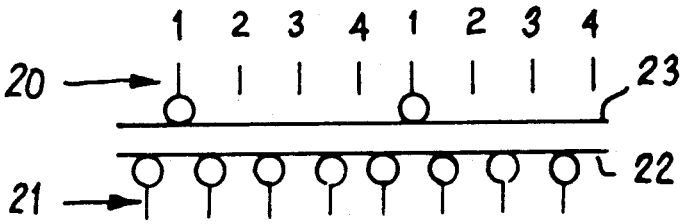
FIGS. 5A to E are stitch diagrams showing the formation of a course-wise fabric line as shown in FIG. 4, FIGS. 6A to D are stitch diagrams showing the formation of a wale-wise fabric line, and FIG. 7 indicates schematically a prior art method of knitting the cover of the seat squab of FIG. 1 without the fabric line featured in this invention.
Figure 5B:
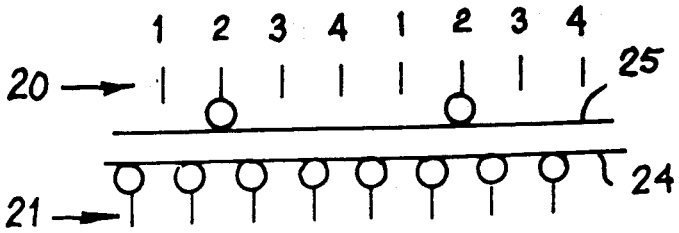

The next course to be knitted is shown in FIG. 5B. Again the polyester yarn 24 is knitted on all of the line of needles 21 producing the front face of the fabric. This time, however, the contractile thread 25 is knitted only on each number 2 needle in the line of needles 20. The thread is then floated over needles 3,4 and 1 after knitting on needle 2, to be picked up on a second needle 2 as is shown in FIG. 5B. Again this takes place throughout the entire width of the fabric in which the tight line is being knitted.

Figure 5C:
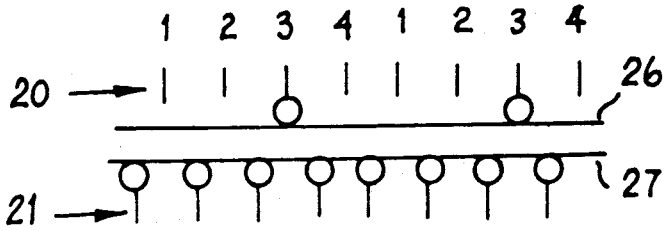

In FIG. 5C it can be seen that the contractile thread 26 is picked up on only the third in the set of four needles in line 20, whereas the polyester yarn 27 is again knitted on all of the needles of the front face 21.

Figure 5D:
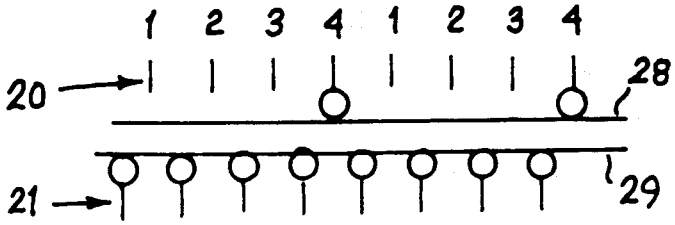

Finally, in the fourth course of threads the contractile thread 28 is knitted on the fourth set of needles and the thread is then floated over needles 1,2 and 3 as can clearly be seen in FIG. 5D. Once again the polyester yarn 29 is knitted on all of the needles in row 21 to produce the front face of the fabric.

Figure 5E:
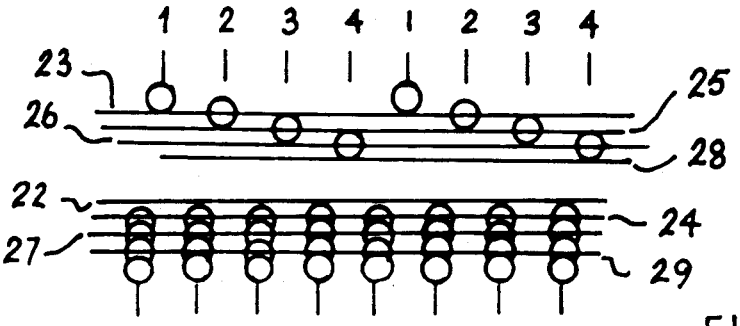

FIG. 5E is a compendium of the FIGS. 5A to D, and it can be seen that each of the row of needles 20 forming the back fabric of the fabric is knitted on in every fourth row whereas the front face needles 21 are knitted continuously. It can be seen, therefore, that the contractile threads are held on every fourth needle but in between the fourth needle they float. Thus after knitting the threads are able, on steaming and shrinking, to shrink down to form a tight line in the fabric to produce the desired effect once the fabric is stretched over the foam bun.

This produces a tight line in a course-wise direction in the fabric. To produce a tight line in a wale-wise direction, the knitting sequence illustrated by means of the stitch diagrams FIGS. 6A to 6D are used.

Figure 6A:
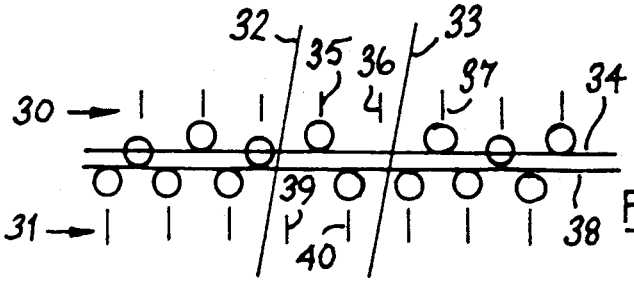
Figure 6B:
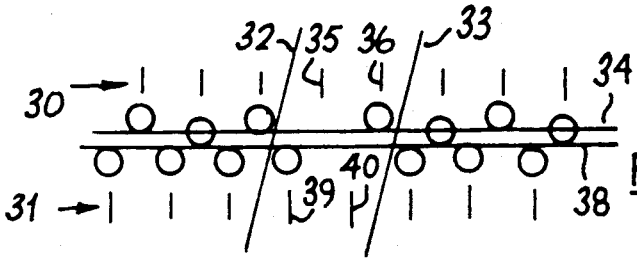
Figure 6C:
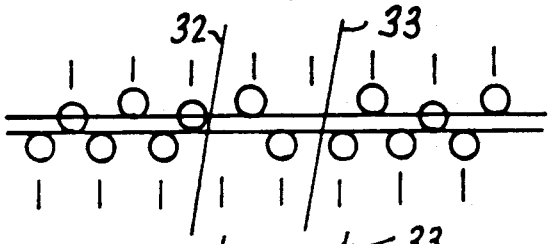
Figure 6D:
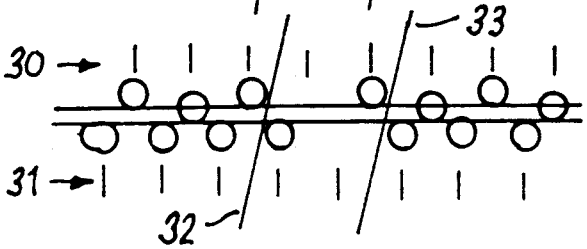

The wale-wise direction tight line is produced by the repetition of a four course knitting sequence. Thus, FIGS. 6A and 6B are repeated, and FIGS. 6C and 6D show this repeat occurring. In FIG. 6A the needles shown in line 30 correspond to the rear needles producing the rear of the fabric. The needles in row 31 correspond to the front needles producing the front of the fabric. To the left of the diagonal line 32 the structure knitted on needles 30 and 31 is a "bird's-eye backed" ground structure of conventional type. Similarly, to the right of diagonal line 33, again there is knitted the "bird's-eye backed" ground structure.

Between the lines 32 and 33 is knitted the two needle wide sequence which produces the wale-wise tight line structure. The polyester yarn 34 is knitted on needle 35 but is then floated across needle 36 to knit again on needle 37. Similarly, the polyester yarn 38 is floated across needle 39 but is knitted on needle 40 on the front of the fabric. In the next course as shown in FIG. 6B the thread 34 is knitted on needle 36 but is floated over needle 35. Similarly, the thread 38 is knitted on needle 39 but is floated over needle 40. This two needle wide sequence on courses shown in FIGS. 6A and 6B is continuously repeated as shown in FIG. 6C and 6D which represent the next four courses knitted.

It can be seen that the knitting structure shown in FIG. 6C is the same between the lines 32 and 33 as is the structure in FIG. 6A, and the structure in FIG. 6D is the same between lines 32 and 33 as the structure in FIG. 6B. This two needle wide sequence is repeated in two course repetition for as long as is required to make the wale-wise tight line.

Because there are less loops in the structure between the lines 32 and 33, the structure between those lines is less extensible under stress as there is less yarn length to deform between the lines. The structure shown in FIGS. 6A to 6D therefore produces a "tight line" structure which is in a wale-wise direction as the structure is built up in a wale-wise direction by repeated knitting of courses with the floated stitches as illustrated.

It can be seen therefore that the "tight line" structure can be produced in either the course-wise direction or in the wale-wise direction. If it is required to produce a tight line at an angle to the line of courses—for example at an angle of 45° then the structure illustrated in FIGS. 6A to 6D could be used but the floated stitches would be moved one needle to the right or the left for each course to produce the inclined "tight line" structure.

What is claimed is:

1. An upholstered three dimensional structure incorporating an internal core and a knitted fabric cover, wherein there is provided in the cover a line along which the fabric is less extensible compared to the surrounding fabric, the line being positioned on the fabric such that the line curves over an edge of the core so that on stretching the fabric over the core the less extensible line is displaced from the general plane of the fabric towards the core.

2. A structure as claimed in claim 1, wherein the core is a foam bun.

3. A structure as claimed in claim 1, wherein the line engages a recess in the core or cuts into the core.

4. A structure as claimed in claim wherein the upholstered structure is a part of a seat.

5. A structure as claimed in claim 1, wherein the line is formed by knitting the fabric cover such that it is less extensible along the line by virtue of one of the number, density and type of stitches used.

6. A structure as claimed in claim 1, wherein at least one reinforcement member is knitted into the fabric along the said line.

7. A structure as claimed in claim 6, wherein the reinforcement member is of a material inherently less extensible than the fabric on knitting.

8. A structure as claimed in claim 6, wherein the reinforcement member is capable of treatment after knitting to form the line.

9. A structure as claimed in claim 8, wherein the reinforcement member is a heat shrinkable yarn.

10. A structure as claimed in claim 1, wherein the fabric is double jersey fabric.

11. A structure as claimed in claim 6, wherein the reinforcement member is applied in a course-wise direction.

12. A structure as claimed in claim 11, wherein the fabric is a double jersey fabric and a reinforcement member is applied to one layer only of the double jersey fabric.

13. A structure as claimed in claim 12, wherein the reinforcement member is formed into a stitch at every second, third, fourth, fifth or sixth location, the reinforcement member being floated over the missed stitches between the front and rear of the fabric.

14. A structure as claimed in claim 12, wherein there is a plurality of reinforcement members, each course of reinforcement members picking up the next adjacent stitch to the previous course.

15. A structure as claimed in claim 13, wherein there are as many courses as there are sets of knitted stitches and missed stitches.

16. A structure as claimed in claim 15, in which the said line is two to eight courses wide in a course-wise direction.

17. A structure as claimed in claim 11, wherein the reinforcement member is one of an elastomeric thread, a heat-fusible thread or a heat-shrinkable thread.

18. A structure as claimed in claim 1, wherein there is provided a line in a wale-wise direction, in which at least one needle is not knitted on in the wale-wise direction whilst knitting the fabric, so that there is provided a less extensible line in a wale-wise direction.

19. A structure as claimed in claim 18, wherein the line is two to four wales wide when knitted in a wale-wise direction.

* * * * *

UNITED STATES PATENT AND TRADEMARK OFFICE

CERTIFICATE OF CORRECTION

PATENT NO. : 5,235,826

DATED : August 17, 1993

INVENTOR(S) : Brooks et al.

It is certified that error appears in the above—identified patent and that said Letters Patent is hereby corrected as shown below:

| | |
|---|---|
| Col. 3, line 31 | cancel "or" and substitute --of--. |
| Col. 4, line 49 | cancel "jointed" and substitute --joined--. |
| Col. 6, line 55 | cancel "bun 1" and substitute --bun 11--. |
| Col. 9, line 35 | (Claim 4) after "claim", insert --1--. |

Signed and Sealed this

Fifteenth Day of March, 1994

*Attest:*

Bruce Lehman

BRUCE LEHMAN

*Attesting Officer*

*Commissioner of Patents and Trademarks*